US009835403B2

(12) United States Patent
Kang

(10) Patent No.: US 9,835,403 B2
(45) Date of Patent: Dec. 5, 2017

(54) CONNECTOR FOR TOY GUN

(71) Applicant: DURINDANA CO., LTD., Cheonan-si Chungcheongnam-do (KR)

(72) Inventor: Hyunmin Kang, Cheonan-si (KR)

(73) Assignee: DURINDANA CO., LTD., Cheonan-si, Chungcheongnam-do (KR)

( * ) Notice: Subject to any disclaimer, the term of this patent is extended or adjusted under 35 U.S.C. 154(b) by 0 days.

(21) Appl. No.: 15/384,332

(22) Filed: Dec. 20, 2016

(65) Prior Publication Data

US 2017/0176130 A1 Jun. 22, 2017

(30) Foreign Application Priority Data

Dec. 21, 2015 (KR) ..... 10-2015-0183021
Apr. 7, 2016 (KR) ..... 10-2016-0042936

(51) Int. Cl.

| | |
|---|---|
| ***F41B 7/00*** | (2006.01) |
| ***F41B 7/08*** | (2006.01) |
| ***F41B 11/55*** | (2013.01) |
| ***F41B 11/646*** | (2013.01) |
| ***F41B 11/71*** | (2013.01) |

(52) U.S. Cl.

CPC ..... *F41B 11/55* (2013.01); *F41B 7/006* (2013.01); *F41B 7/08* (2013.01); *F41B 11/646* (2013.01); *F41B 11/71* (2013.01)

(58) Field of Classification Search

CPC ..... F41B 7/006; F41B 7/08; F41B 11/50
See application file for complete search history.

(56) References Cited

U.S. PATENT DOCUMENTS

| | | | | |
|---|---|---|---|---|
| 6,457,271 | B1 * | 10/2002 | Vaid | F41A 17/36 42/11 |
| 8,156,930 | B2 * | 4/2012 | Hu | F41A 17/36 124/51.1 |
| 9,273,925 | B1 * | 3/2016 | Liao | F41A 17/36 |
| 2010/0043766 | A1 * | 2/2010 | Iwasawa | F41A 17/34 124/40 |

FOREIGN PATENT DOCUMENTS

| | | | |
|---|---|---|---|
| KR | 10-1282903 | B1 | 7/2013 |
| KR | 10-2016-0122925 | A | 10/2016 |
| WO | 2005/066574 | A1 | 7/2005 |

* cited by examiner

*Primary Examiner* — John Ricci
(74) *Attorney, Agent, or Firm* — Revolution IP, PLLC

(57) ABSTRACT

Provided is a connector for a toy gun having a feature for detecting whether or not a projectile remains. The connector includes a connector body coupled to the toy gun to be connected with an upper portion of a magazine when the magazine is inserted into the toy gun, a hole formed to pass through front end of the connector body and configured to accommodate the projectile provided by the magazine, a projectile fixing portion positioned on the connector body in which the hole is formed to fix the projectile provided via the hole, a projectile sensing portion which senses whether or not a projectile remains in the hole; and a first protrusion interlocked with the projectile sensing portion to control movement of a cylinder of the toy gun depending on whether or not a projectile remains in the hole.

16 Claims, 15 Drawing Sheets

【FIG. 1】
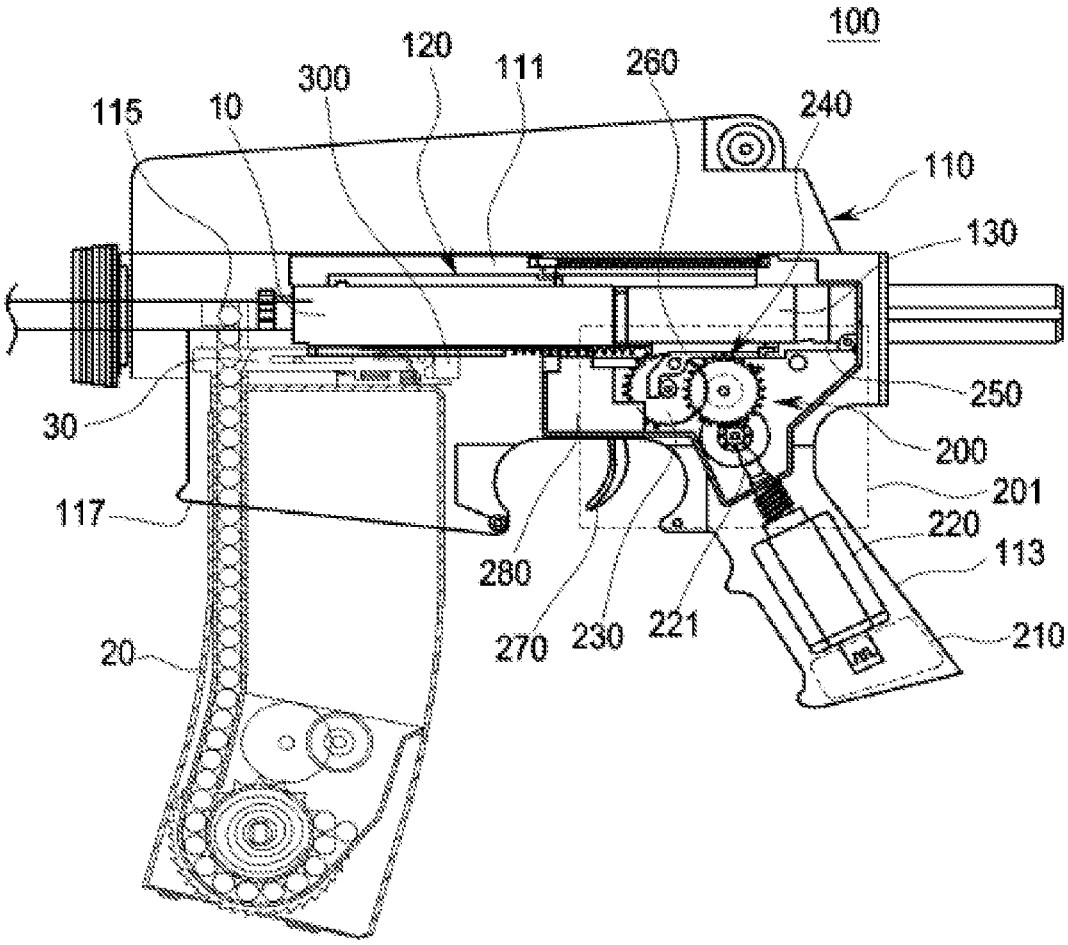

【FIG. 2】
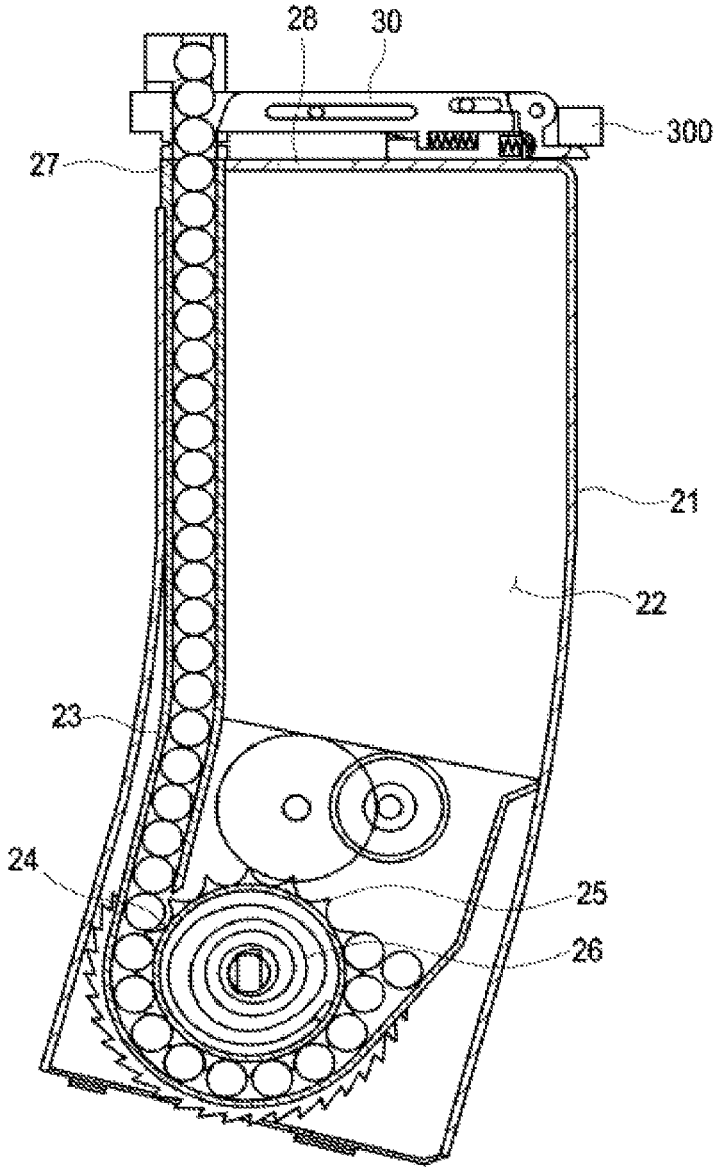

【FIG. 3】
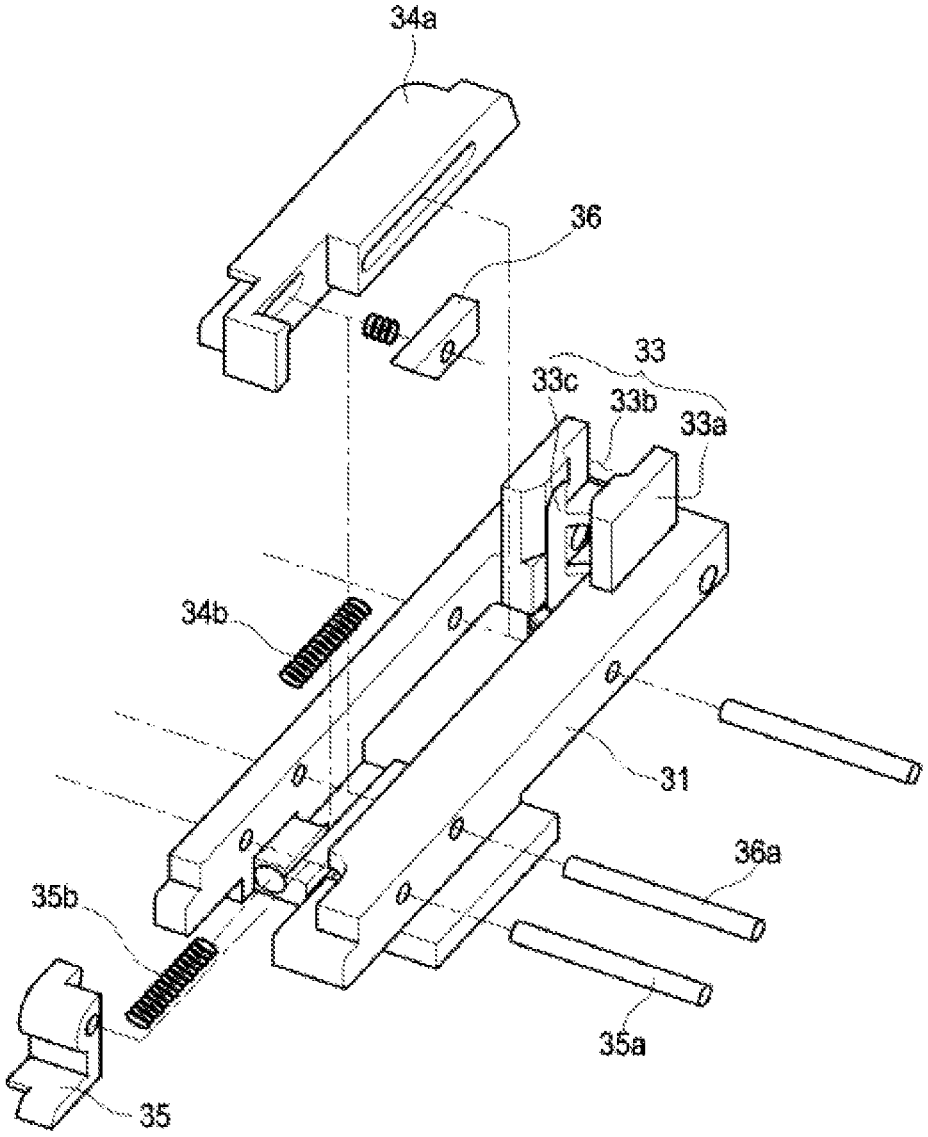

【FIG. 4a】
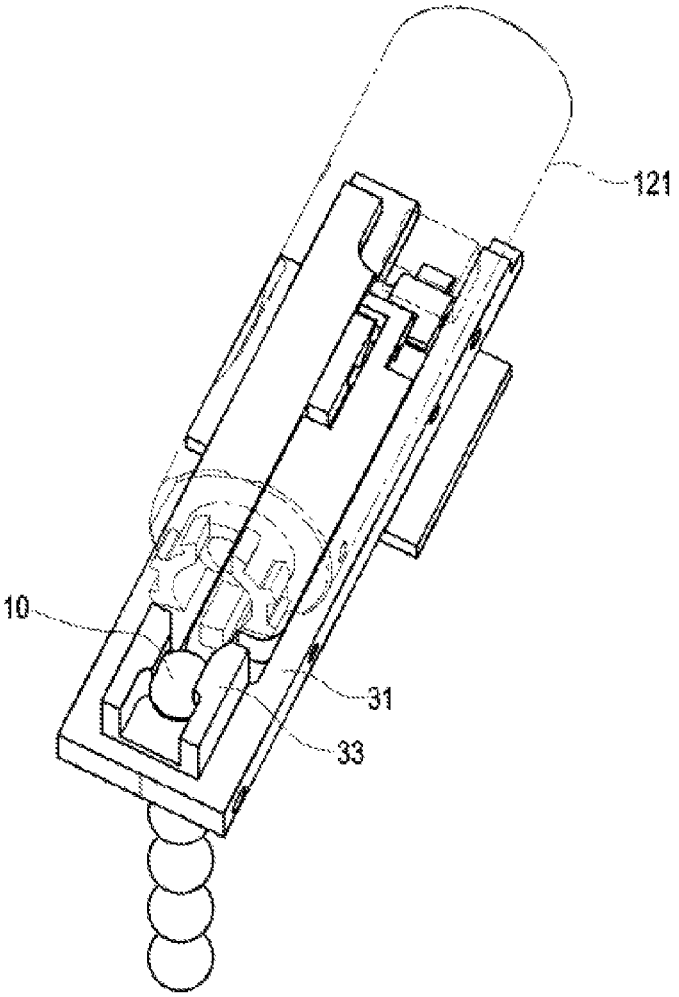
【FIG. 4b】
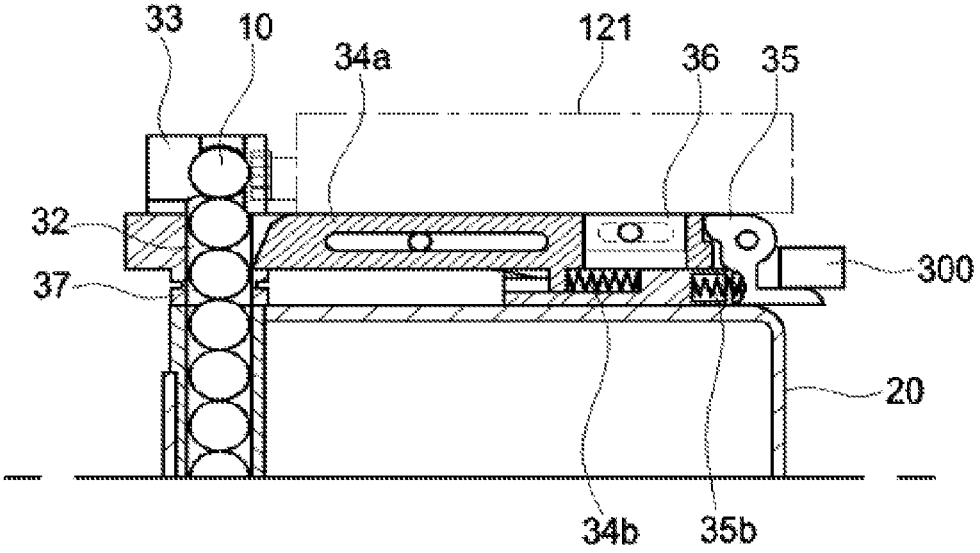

【FIG. 5a】
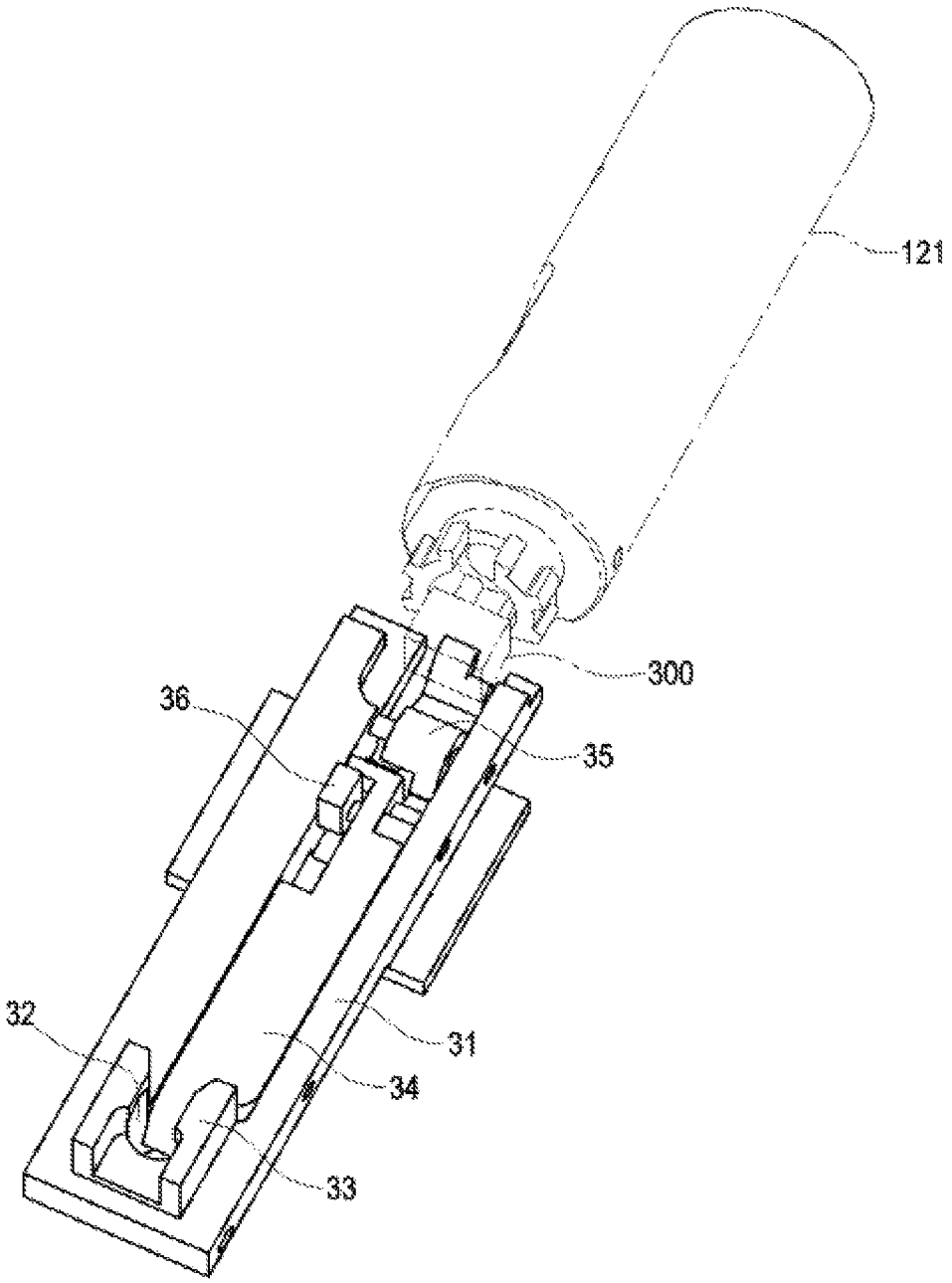

【FIG. 5b】
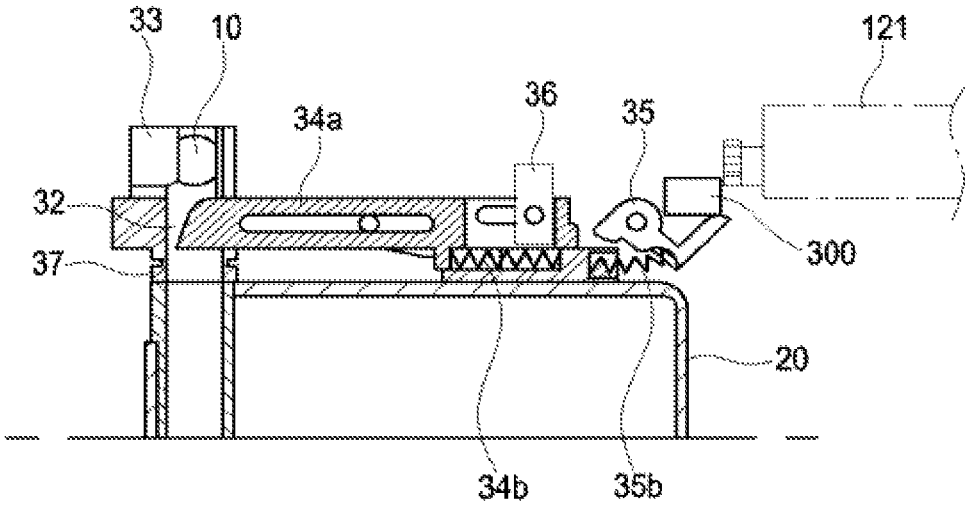
【FIG. 6】
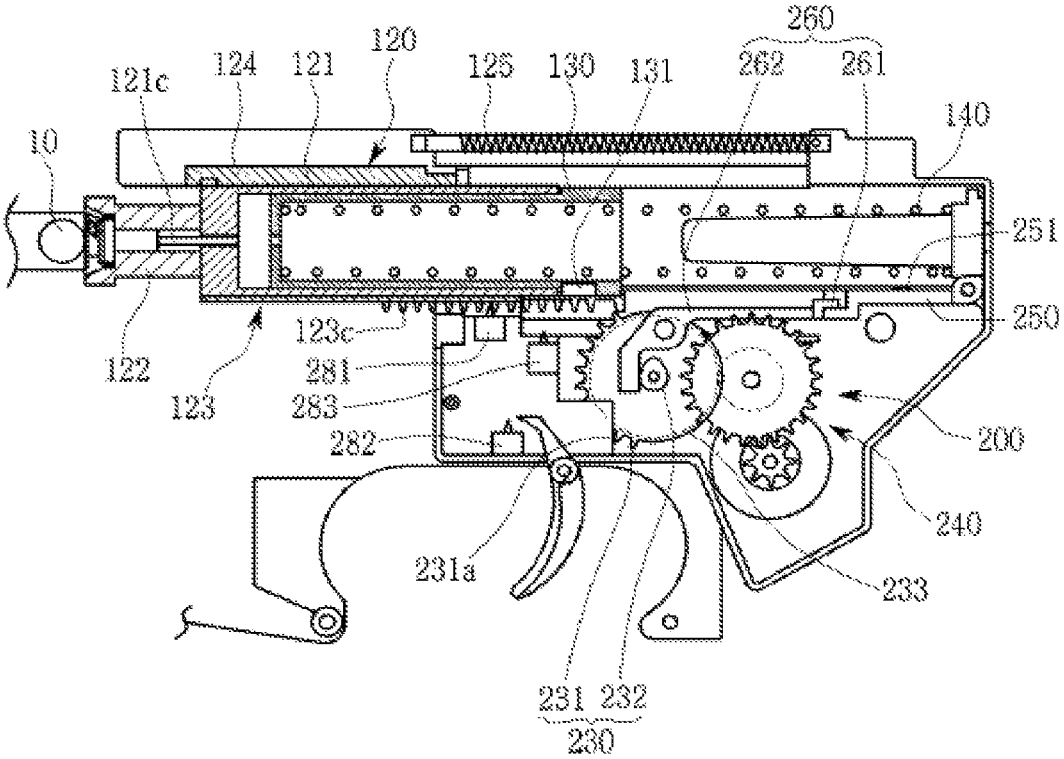

【FIG. 7】
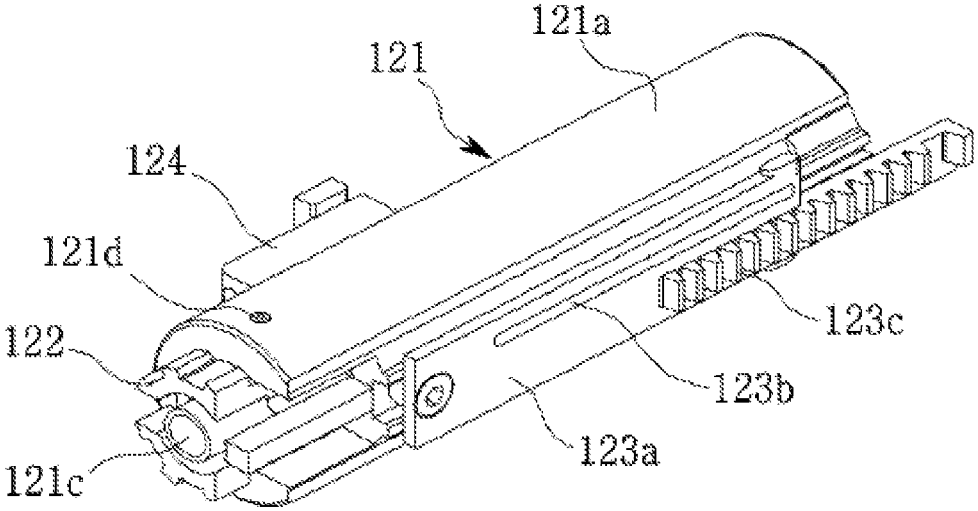
【FIG. 8】
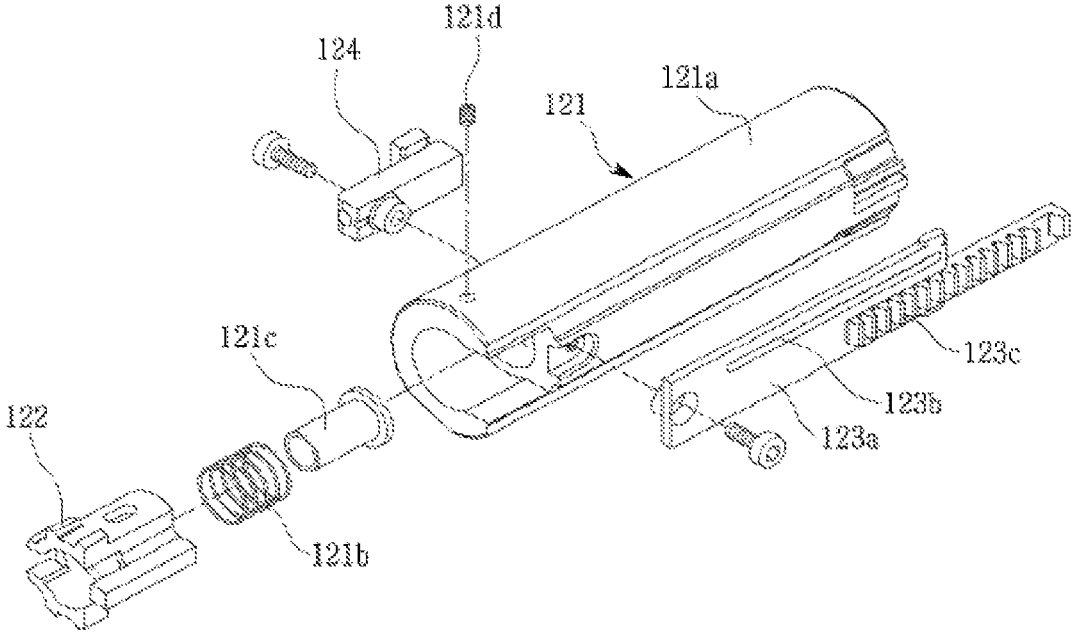

【FIG. 9】
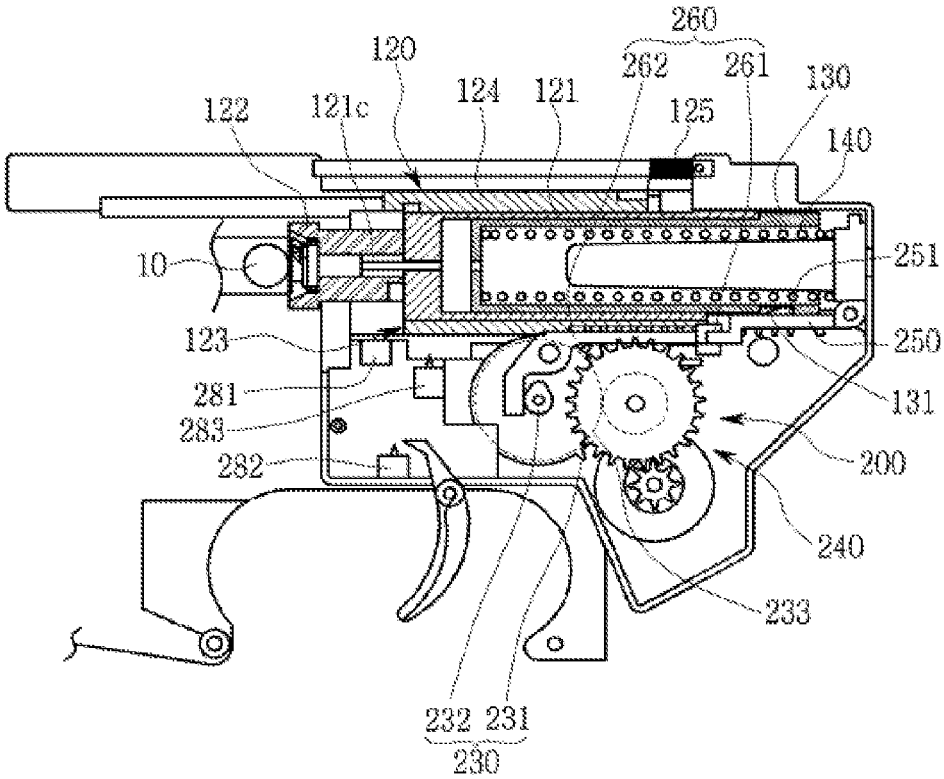
【FIG. 10】
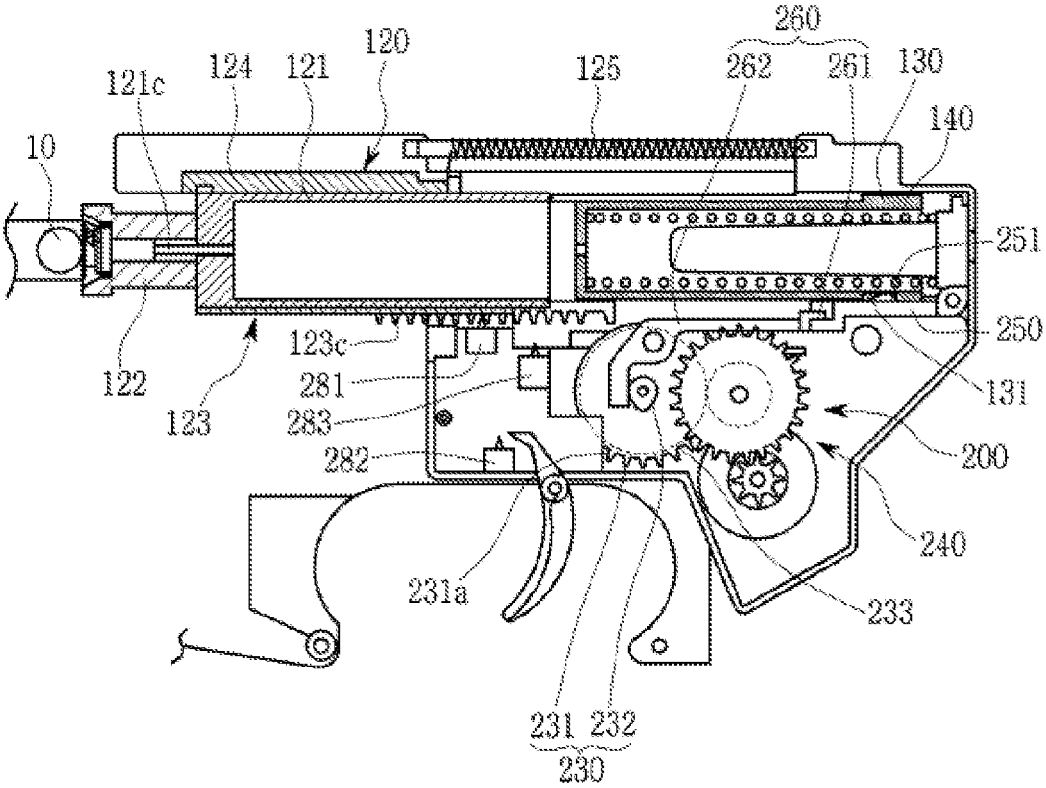

【FIG. 11】
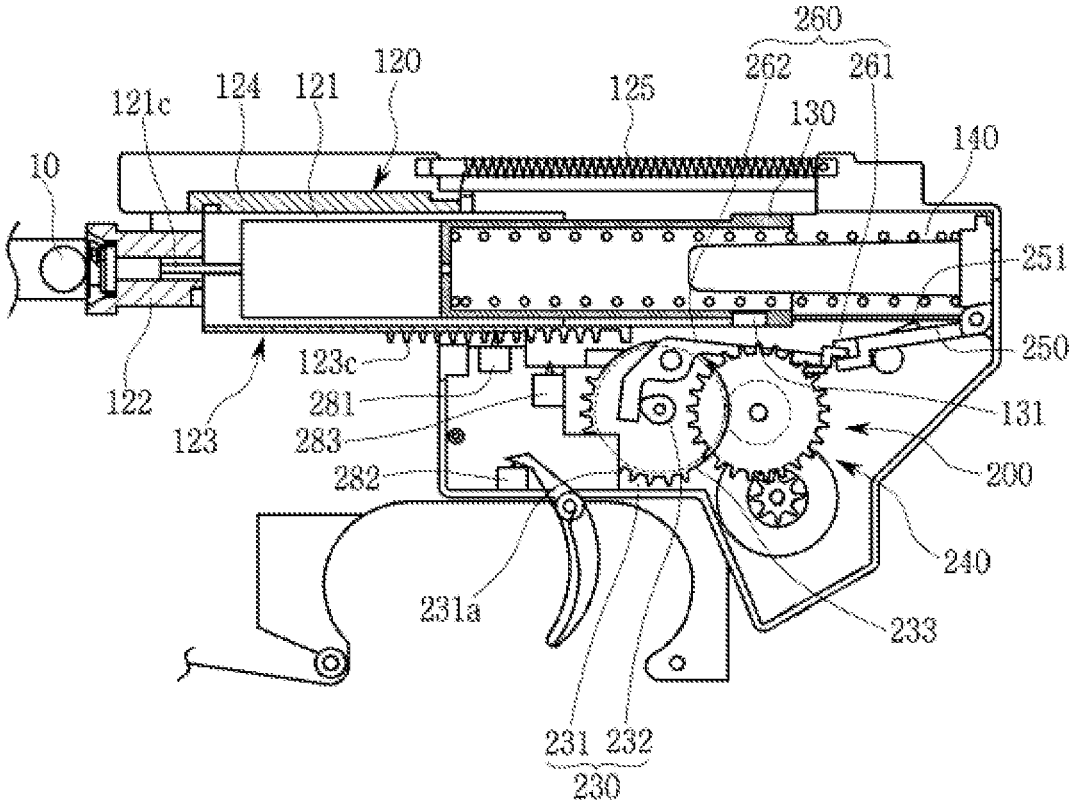
【FIG. 12】
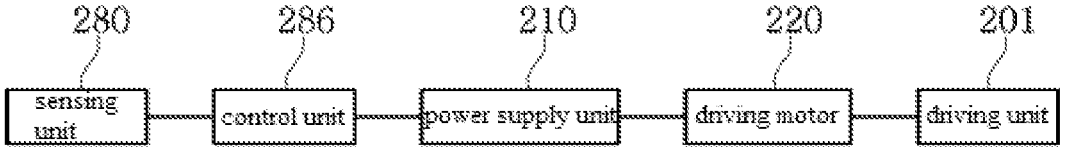

【FIG. 13】
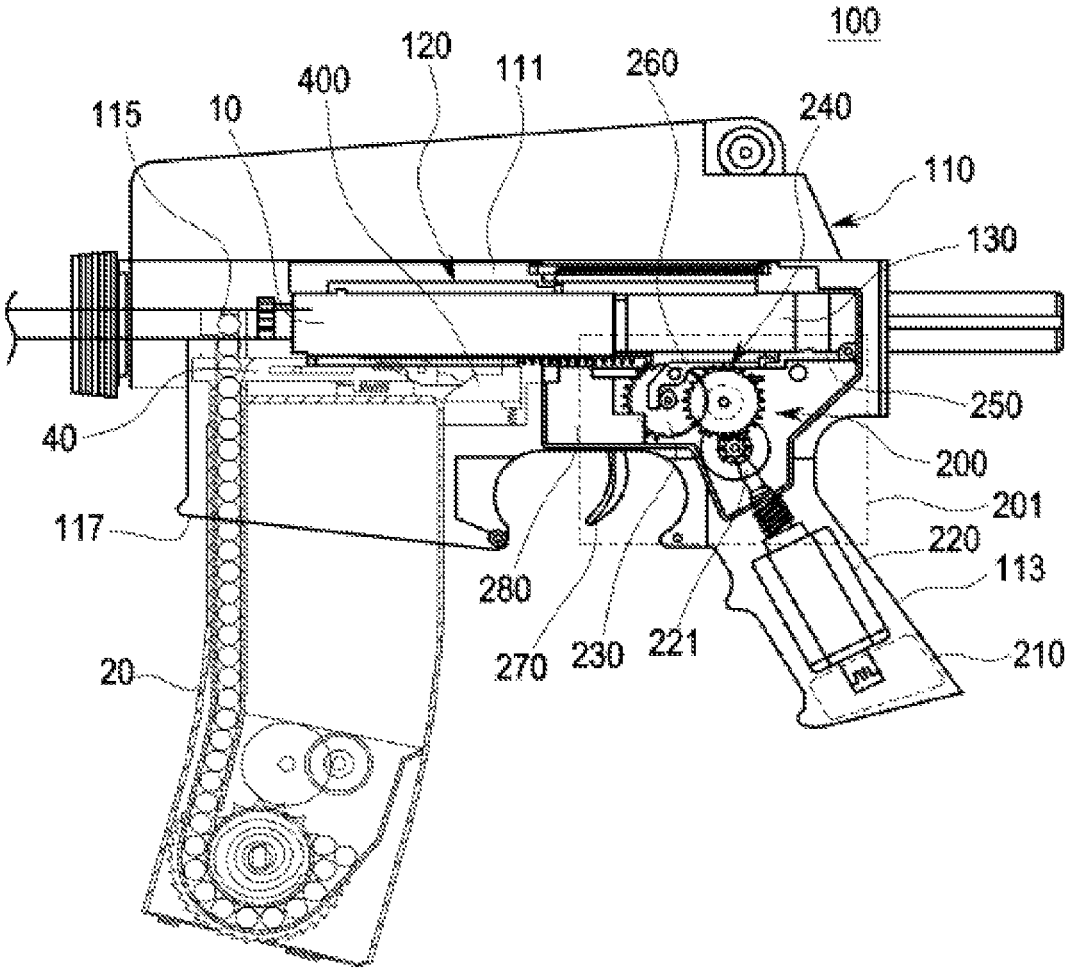

【FIG. 14】
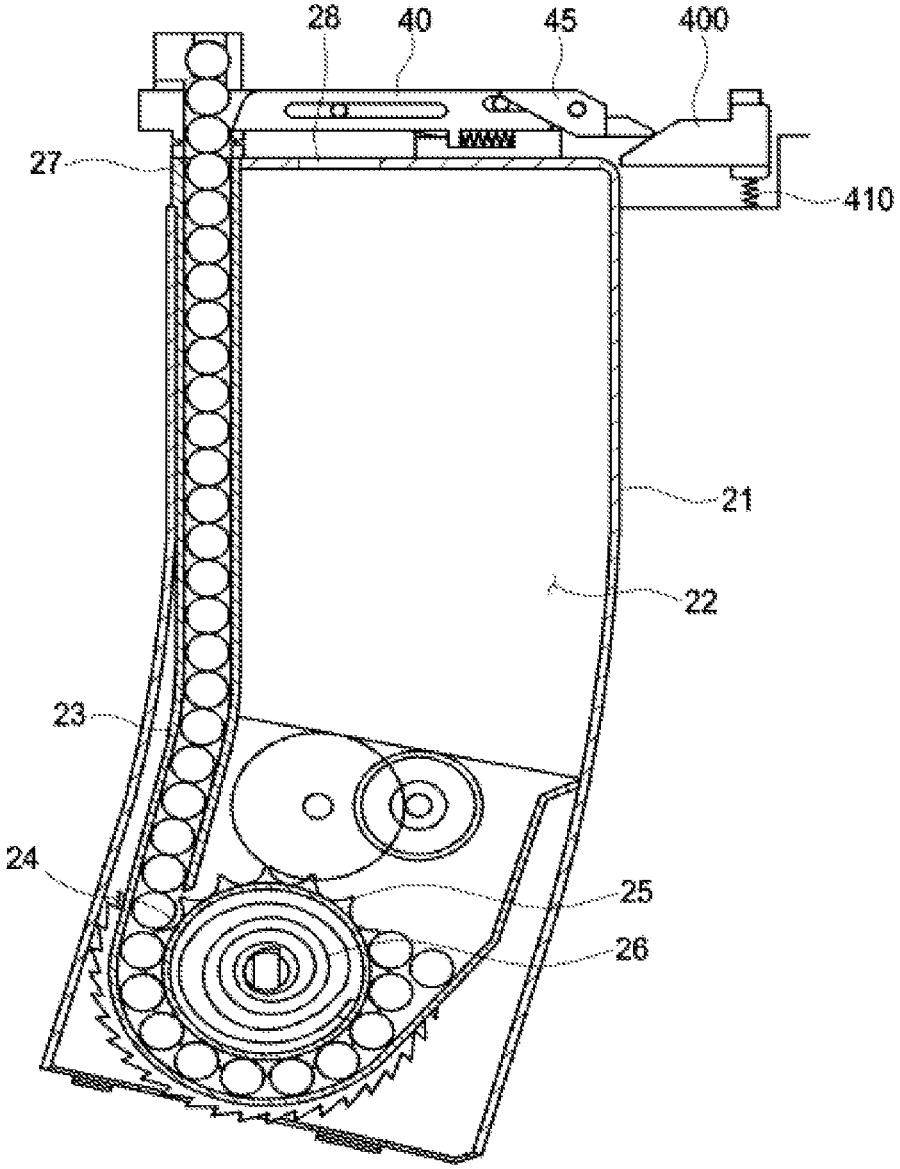

【FIG. 15】
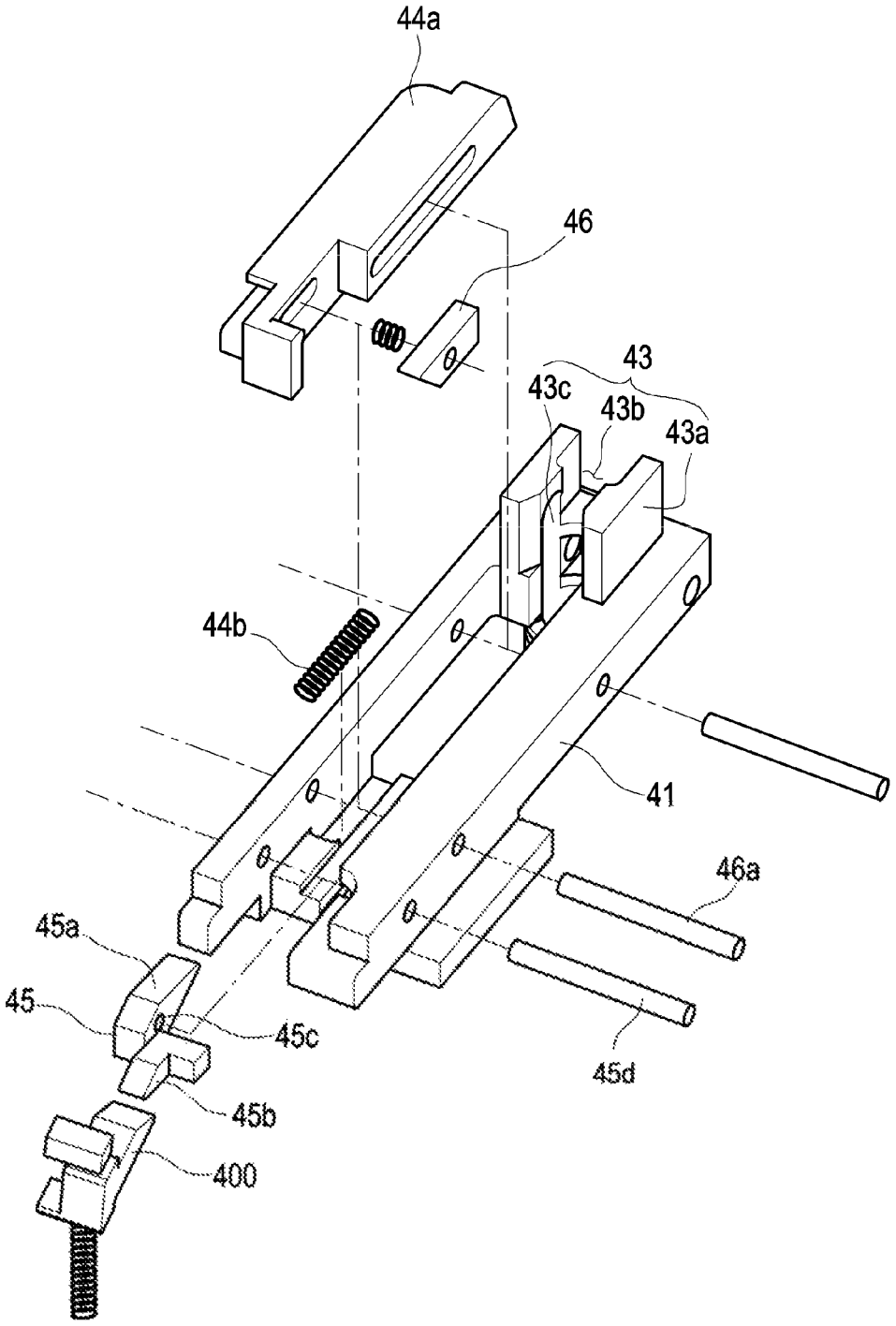

【FIG. 16a】
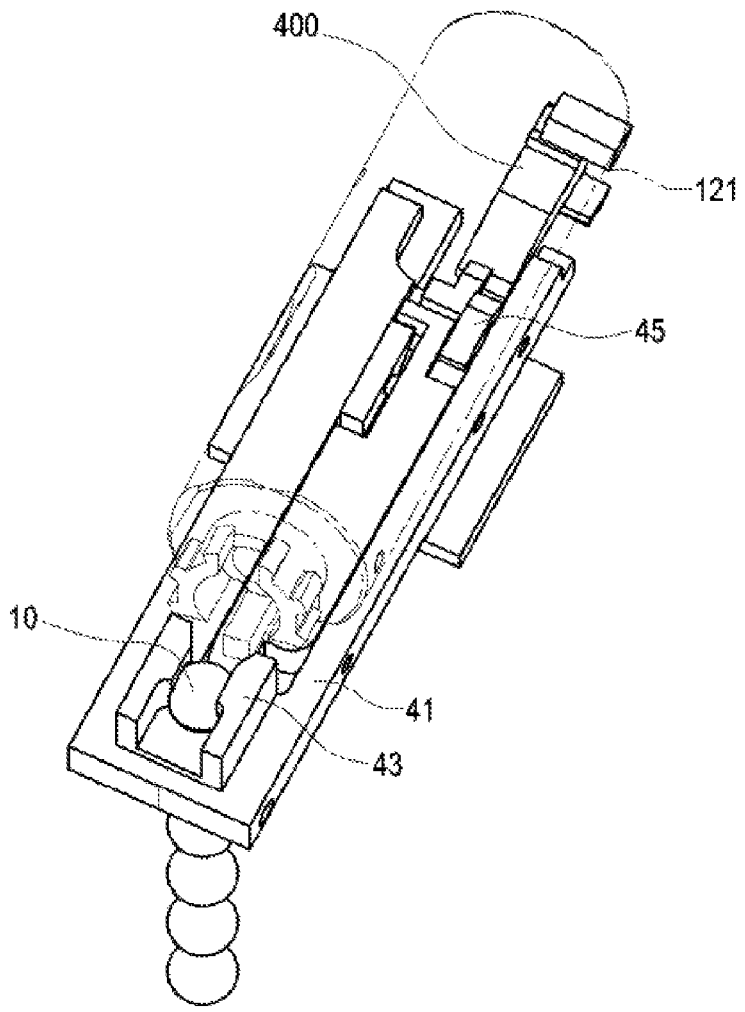
【FIG. 16b】
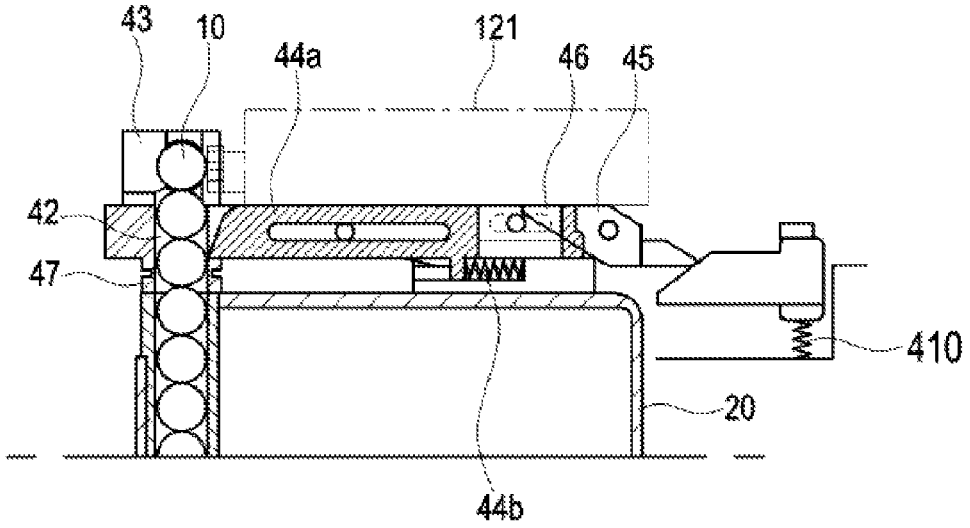

【FIG. 17a】
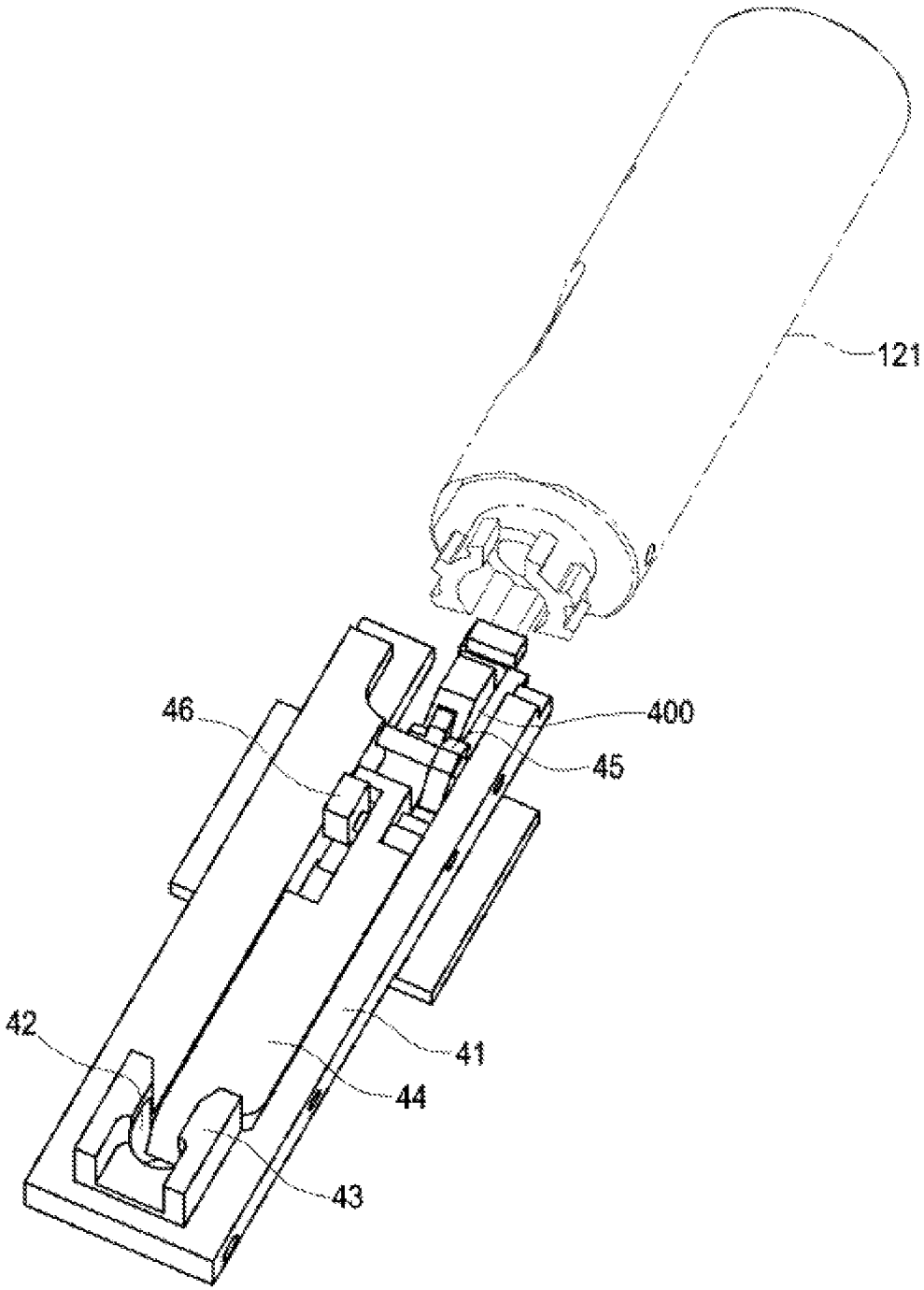

【FIG. 17b】
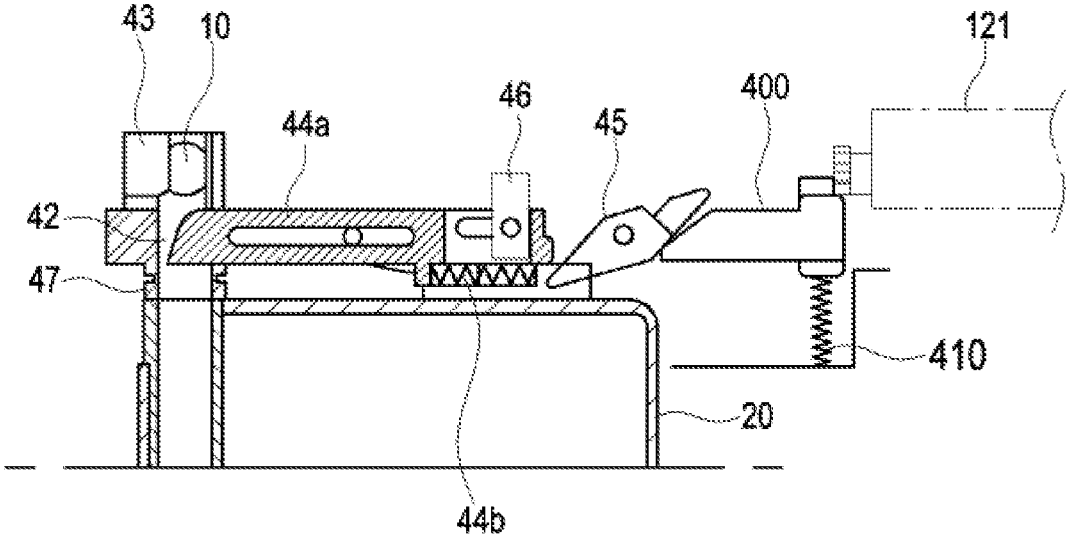

CONNECTOR FOR TOY GUN

CROSS-REFERENCE TO RELATED APPLICATION

This application claims priority to and the benefit of Korean Patent Application No. 2015-0183021, filed on Dec. 21, 2015 and Korean Patent Application No. 2016-0042936, filed on Apr. 7, 2016, the disclosure of which is incorporated herein by reference in its entirety.

BACKGROUND

1. Field of the Invention

The present invention relates to a connector for a toy gun, and more particularly, to a connector capable of controlling cocking of a toy gun, depending on whether or not a projectile remains in the toy gun.

2. Discussion of Related Art

As societies develop, people have come to enjoy diverse leisure activities for reasons such as health, hobbies, and the like, and leisure activity population is also gradually increasing. Among the diverse leisure activities, survival games are gradually growing in developed countries in terms of participating population as well as market size. In the case of such a survival game, mock allied forces and mock enemy forces play a survival game using a toy gun in a shape similar to a real gun and thereby promoting health, stress reduction, friendship, realistic military training, and the like.

Specifically, in the case of a conventional toy gun for a survival game, a projectile such as a BB pellet supplied from a magazine and positioned at front end of a cylinder is fired when a piston moved back in the cylinder suddenly thrusts forward by force of compressed air or a spring.

In the case of the conventional toy gun for a survival game described above, with the cylinder fixed, only the piston reciprocates forward and backward to fire the projectile. In addition, a rack gear portion is formed outside of the piston, a gear train connected to the rack gear portion by gear engagement is driven by an electric motor, and thereby the piston is automatically moved to a position (a moved back position) ready for firing.

Meanwhile, in the case of the conventional toy gun for a survival game described above, when damage occurs to a gear due to repetitive use impacts malfunction, etc., there arises a problem in which the whole piston assembly needs to be replaced because the piston and the rack gear portion are integrally formed. In addition, such a piston is formed of an expensive metal material, resulting in much of financial burden put on a user.

In addition, in the case of the conventional toy gun, a user cannot determine whether or not a projectile remains, and therefore a piston is unnecessarily reciprocated by cocking by a user even when there is no projectile.

SUMMARY OF THE INVENTION

The present invention is directed to providing a connector for a toy gun capable of sensing whether or not a projectile remains in the toy gun.

In addition, the present invention is directed to providing a connector for a toy gun capable of controlling cocking of a toy gun, depending on whether or not a projectile remains in the toy gun.

The technical objectives of the present invention are not limited to the above objects, and other objectives not described herein may become apparent to those of ordinary skill in the art based on the following description.

According to an aspect of the present invention, there is provided a connector for a toy gun, including: a connector body coupled to the toy gun to be connected with an upper portion of a magazine when the magazine is inserted into the toy gun; a hole formed to pass through front end of the connector body and configured to accommodate a projectile provided by the magazine; a projectile fixing portion positioned on the connector body in which the hole is formed and configured to fix the projectile provided via the hole; a projectile sensing portion which senses whether or not a projectile remains in the hole; and a first protrusion interlocked with the projectile sensing portion to control a movement of a cylinder of the toy gun depending on whether or not a projectile remains in the hole.

According to another aspect of the present invention, there is provided a connector for a toy gun, including: a connector body coupled to the toy gun to be connected with an upper portion of a magazine when the magazine is inserted into the toy gun; a hole formed to pass through front end of the connector body and configured to accommodate a projectile provided by the magazine; a projectile fixing portion positioned on the connector body in which the hole is formed and configured to fix the projectile provided via the hole; a projectile sensing portion whose position changes in the connector body depending on whether or not a projectile remains in the hole; and a first protrusion allowed to rotate by the projectile sensing portion depending on whether or not a projectile remains in the hole and configured to rotate by pressure of a stopper which controls a movement of a cylinder in the toy gun.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which:

FIG. 1 is a schematic configuration view of a toy gun according to a first embodiment of the present invention;

FIG. 2 is a view illustrating a magazine and a connector according to the first embodiment of the present invention;

FIG. 3 is a detailed view illustrating a connector according to the first embodiment of the present invention;

FIGS. 4A and 4B illustrate a connector of the first embodiment, in which there is a remaining projectile;

FIGS. 5A and 5B illustrate a connector of the first embodiment, in which there is no projectile;

FIG. 6 is a detailed view illustrating a toy gun according to the first embodiment of the present invention;

FIGS. 7 and 8 are detailed views illustrating a cylinder assembly of a toy gun according to the first embodiment of the present invention;

FIG. 9 is a view illustrating a state in which a cylinder and a piston of a toy gun are moved back according to the first embodiment of the present invention;

FIG. 10 is a view illustrating a state in which a cylinder of a toy gun is moved forward (in a state ready to fire) according to the first embodiment of the present invention;

FIG. 11 is a view illustrating a process in which a piston of a toy gun moves forward according to the first embodiment of the present invention;

FIG. 12 is a diagram illustrating a driving control mechanism of a toy gun according to the first embodiment of the present invention;

FIG. 13 is a schematic configuration view of a toy gun according to a second embodiment of the present invention;

FIG. 14 is a view illustrating a magazine and a connector according to the second embodiment of the present invention;

FIG. 15 is a detailed view illustrating a connector according to the second embodiment of the present invention;

FIGS. 16A and 16B illustrate a connector of the second embodiment in which there is a remaining projectile; and FIGS. 17A and 17B illustrate a connector of the second embodiment in which there is no projectile.

DETAILED DESCRIPTION OF EXEMPLARY EMBODIMENTS

The objects, features, and advantages described above will become more apparent from the following detailed description of the embodiments of the present invention with reference to the accompanying drawings, and thereby those skilled in the art may easily implement the technical spirit of the present invention. In the following description, detailed descriptions of well-known technologies will be omitted where they may unnecessarily obscure the subject matters of the present invention.

First Embodiment

Hereinafter, a toy gun will be described in detail according to a first embodiment of the present invention and with reference to the accompanying drawings.

Referring to FIG. 1, a toy gun 100 according to the first embodiment of the present invention includes a magazine 20, a connector 30, a toy gun main body 110 having a cartridge chamber into which a projectile 10 supplied from the connector 30 is individually loaded, a cylinder assembly 120, a piston 130, and a driving control mechanism 200.

As illustrated in FIG. 2, as an example, the magazine 20 includes a magazine body 21, a storage space 22, a feed tube 23, a feed wheel 24, a protrusion 25, an elastic body 26, an outlet 27, and an insertion port 28.

The magazine body 21 is formed in a size and shape that allows detachable installation on the toy gun 100, and the storage space 22 is a space for storing the projectile 10. In addition, the feed tube 23 is disposed inside the magazine body 21 and is formed in a tube shape to move the projectile 10 upward. The feed wheel 24 is disposed at a lower portion inside the magazine body 21, and the protrusion 25 is formed in a sawtooth shape on a perimeter of the feed wheel 24 so that the projectile 10 is individually supported. The projectiles 10 are supplied to the feed tube 23 by rotation of the feed wheel 24. In addition, the elastic body 26 is disposed inside the feed wheel 24 and is formed as a clockwork spring to provide elasticity for rotating the feed wheel 24. The outlet 27 is formed at an upper portion of the magazine body 21 to discharge the projectile 10 to the outside, and the insertion port 28 also is formed at the upper portion of the magazine body 21 and is configured to be openable and closable for replenishing the projectile 10 into the storage space 22.

As illustrated in FIG. 3, the connector 30 includes a connector body 31, a hole 32, a projectile fixing portion 33, a projectile sensing portion 34, a first protrusion 35, a second protrusion 36, and a cylindrical entrance 37. The connector 30 may be fixed inside the toy gun main body 110 or inserted into the toy gun main body 110 along with the magazine 20 when the magazine 20 is inserted into the toy gun main body 110. The present embodiment describes the connector 30 fixed inside the toy gun main body 110.

When the magazine 20 is inserted into the toy gun main body 110, the connector body 31 is coupled to the toy gun main body 110 to be connected to an upper portion of the magazine 20.

The hole 32 is formed to pass through front end of the connector body 31 and configured to accommodate the projectile 10 provided by the magazine 20. The hole 32 has a greater diameter than the projectile 10 so that the projectile 10 may pass therethrough.

The projectile fixing portion 33 is formed on the connector body 31 at which the hole 32 is formed and includes right and left side walls 33*a* for fixing the projectile 10 provided via the hole 32 and an aisle 33*b* between the right and left side walls 33*a* so that the projectile 10 moves to the cartridge chamber by pressure from the cylinder assembly 120. Each of the right and left side walls 33*a* includes grooves 33*c* which may accommodate and fix the projectile 10 at inside surfaces thereof.

The projectile sensing portion 34 is for sensing whether or not a projectile 10 remains in the magazine 20 and the hole 32 and includes a plate 34*a* inserted into the connector body 31 and a spring 34*b* which pushes the plate 34*a* toward the hole 32. When there is no projectile in the hole 32, the plate 34*a* is inserted into the hole 32 through a side surface of the hole 32, and conversely when there is a remaining projectile 10 in the hole 32, the plate 34*a* is positioned outside of the hole 32 because the plate 34*a* is not allowed to be inserted into the hole 32 due to a remaining projectile 10. Therefore, whether or not a projectile remains in the hole 32 may be determined depending on a position of the plate 34*a*. In addition, front end of the plate 34*a* is formed to have a slope so that a lower surface is longer than an upper surface for easily pushing up the remaining projectile 10 toward projectile fixing portion 33. The projectile sensing portion 34 is positioned between the hole 32 and the first protrusion 35.

The first protrusion 35 is inserted into rear end of the connector body 31 to be vertically rotatable about a first rotating shaft 35*a* and is provided with rotating force by a spring 35*b* positioned thereunder. The first protrusion 35 is interlocked with the projectile sensing portion 34 to rotate depending on whether or not a projectile remains in the hole 32, and the first protrusion 35 controls a movement of a cylinder 121 of the toy gun 100 by the rotation. For example, when there is a remaining projectile 10 in the hole 32 as illustrated in FIGS. 4A and 4B, the plate 34*a* lays down and fixes the first protrusion 35. Accordingly, the first protrusion 35 allows the cylinder 121 to pass the connector 30 and move toward the projectile fixing portion 33. Conversely, when there is no projectile in the hole 32 as illustrated in FIGS. 5A and 5B, the plate 34*a* and the first protrusion 35 become spaced apart from each other as the plate 34*a* moves toward the hole 32, and thereby the first protrusion 35 rotates upward. That is, the first protrusion 35 is allowed to rotate by the plate 34*a* and rotates by the spring 35*b*. Therefore, the first protrusion 35 blocks the cylinder 121 from moving toward the projectile fixing portion 33. Here, although the first protrusion 35 itself may be formed to control movement of the cylinder 121 by vertical rotation, the first protrusion 35 controls the movement of the cylinder 121 in the present embodiment by vertically moving a stopper 300 that is to be described below.

The second protrusion 36 is formed at a side surface of the plate 34*a* to be rotatable about a second rotating shaft 36*a* and is formed to be interlocked with the projectile sensing portion 34 to protrude from a surface of the connector body 31 depending on whether or not a projectile remains in the hole 32. For example, when there is a remaining projectile 10 in the hole 32 as illustrated in FIGS. 4A and 4B, the plate 34*a* lays down and fixes the second protrusion 36, and accordingly, the second protrusion 36 remains inserted in the connector body 31. In addition, while a remaining projectile 10 in the hole 32 moves toward the projectile fixing portion 33, the second protrusion 36 remains inserted in the connector body 31 due to pressure of a lower portion of the cylinder 121. Conversely, when there is no projectile in the hole 32 as illustrated in FIGS. 5A and 5B, the second protrusion 36 protrudes from the surface of the connector body 31, as the plate 34*a* moves toward the hole 32. After this, when the cylinder 121 moves toward the projectile fixing portion 33, the second protrusion 36 is inserted into the connector body 31 again due to the pressure of a lower portion of the cylinder 121, and the plate 34*a* escapes out of the hole 32 by rotation of the second protrusion 36.

The cylindrical entrance 37 is formed under the hole 32 to connect the outlet 27 of the magazine 20 and the hole 32. The cylindrical entrance 37 is formed to be provided with the projectile 10 from the outlet 27 of the magazine 20 and has a greater diameter than the projectile 10 so that the projectile 10 passes therethrough.

The toy gun main body 110 includes a barrel portion 111, a handgrip 113 connected to a lower portion of the barrel portion 111, and a cartridge chamber 115 provided at front end of the barrel portion 111. The cylinder assembly 120 and the piston 130 are installed to reciprocate in the barrel portion 111.

A power supply unit 210 and a driving motor 220 of the driving control mechanism 200 may be built in the handgrip 113.

A projectile 10 (may be a BB pellet or a combined BB pellet and pellet-shell) is individually supplied and loaded into the cartridge chamber 115. The cartridge chamber 115 is formed to receive the projectile 10 from the projectile fixing portion 33. The magazine 20 is coupled to the toy gun main body 110 through a magazine coupling portion 117.

The projectile 10 may include a configuration of a normal BB pellet combined to front end of a pellet-shell and also include only a normal BB pellet. The projectile 10 passes the outlet 27 of the magazine 20 and is individually supplied to the cartridge chamber 115 via the projectile fixing portion 33.

The cylinder assembly 120 is formed to reciprocate in the barrel portion 111. As illustrated in FIG. 6, the cylinder assembly 120 includes the cylinder 121, a rack gear portion 123 detachably installed at the cylinder 121, and a guide portion 124.

As illustrated in FIGS. 7 and 8, the cylinder 121 includes a cylinder body 121*a* in a cylindrical shape, a cylinder head 122 inserted into front end of the cylinder body 121*a*, a spring 121*b* positioned between the cylinder body 121*a* and the cylinder head 122 to space the cylinder head 122 from the cylinder body 121*a*, a nozzle 121*c* inserted into the cylinder head 122 to pass through the cylinder head 122, and a stopper 121*d* for preventing separation between the cylinder body 121*a* and the cylinder head 122.

The cylinder 121 is formed to reciprocate (moving backward and moving forward) in the toy gun main body 110 to be ready for firing, and no structure (for example, a side surface guider for the cylinder.) exists between left and right side surfaces of the cylinder 121 and left and right inside surfaces of the toy gun main body 110 so that the left and right side surfaces of the cylinder 121 face the left and right inside surfaces of the toy gun main body 110 at the closest possible distance. In this case, a sense of reality may be increased because a user may feel and visually check the reciprocating actions of the cylinder 121 like a real gun. In addition, capacity of the cylinder 121 may be maximized and thus amount of compressed air generated by the cylinder 121 may be maximized because no other structure exists, such as a side surface guider.

The spring 121*b* provides elasticity that pushes the cylinder head 122 from the cylinder body 121*a*, thereby mitigating a physical impact occurring when the cylinder 121 moves forward and collides with the toy gun main body 110. In addition, when the cylinder 121 moves backward due to recoil after the collision, the spring 121*b* pushes the cylinder head 122 forward, and thereby the seal of the cartridge chamber 115 may be maintained.

Since the nozzle 121*c* has a smaller diameter than the spring 121*b*, the nozzle 121*c* is inserted not only into the cylinder head 122 but also into the spring 121*b*. In addition, a front end portion of the nozzle 121*c* protrudes forward from the cylinder head 122 to discharge high pressure air, and rear end of the nozzle 121*c* is inserted into front end of the cylinder body 121*a*.

The stopper 121*d* passes through a hole formed at one side surface of the cylinder body 121*a* and inserted into a groove formed at a side surface of the cylinder head 122 corresponding to the one side surface of the cylinder body 121*a*.

The rack gear portion 123 is formed under the cylinder 121 with a length corresponding to the length of the cylinder body 121*a*. Unlike the cylinder body 121*a*, the rack gear portion 123 may be formed of a nonmetal material or may also be formed of a metal material.

The rack gear portion 123 includes a rack gear tooth 123*c* formed at a lower surface and in a length direction of the rack gear portion 123. In addition, the rack gear portion 123 includes a contact surface 123*a* in contact with a first sensor 281 of a sensing unit 280 and a groove 123*b* formed in a length direction of the rack gear portion 123 not to be in contact with the first sensor 281. The contact surface 123*a* and the groove 123*b* are positioned at a lower surface of the rack gear portion 123 and next to the rack gear tooth 123*c*.

The rack gear portion 123 is separately provided by the cylinder body 121*a* and is formed to be assembled and separated by a bolt or the like so that the rack gear portion 123 may be replaced with a new one in the case that the rack gear tooth 123*c* of the rack gear portion 123 does not work normally due to damage or breakage when used for a long time. That is, only the rack gear portion 123 may be replaced unlike the conventional method in which the whole expensive cylinder assembly 120 needs to be replaced and thereby having an advantage of reducing cost. Specifically, since the cylinder body 121*a* normally is made of expensive brass to prevent deformation while maintaining certain solidity and to reduce weight, the configuration provided with the separate rack gear portion 123 to be coupled instead of integrally manufacturing the rack gear and the expensive cylinder body 121*a* provides an advantage of not only reducing an financial burden for a user but also reducing waste of resources.

In addition, the rack gear portion 123 guides the reciprocating action of the cylinder assembly 120 in the toy gun main body 110 without contact between the surfaces of the cylinder 121 and the inside surfaces of the toy gun main body 110. Since the rack gear portion 123 does not bring the surfaces of the cylinder 121 into contact with the inside surfaces of the toy gun main body 110, the rack gear portion 123 can reduce the frictional resistance of the cylinder assembly 120.

The guide portion 124 is formed on the cylinder body 121*a* and stably guides the reciprocating action of the cylinder assembly 120 along with the rack gear portion 123. A return spring 125 is connected to the guide portion 124 to return the cylinder assembly 120 to an initial position from a state in which the cylinder assembly 120 is moved back. The guide portion 124 may be made of a nonmetal material such as a plastic or the like or may also be made of a metal material.

The piston 130 is installed to reciprocate in the cylinder body 121*a*, moves backward along with the cylinder 121 when the cylinder 121 moves backward as illustrated in FIG. 9, and is locked by a locking member 250 of the driving control mechanism 200 to maintain a state ready to fire. After this, only the cylinder assembly 120 separately moves forward as illustrated in FIG. 10.

A locking portion 131 coupled to and locked by the locking member 250 of the driving control mechanism 200 is formed at an outer side of the piston 130. The locking portion 131 may be variously implemented in a shape of a hooked jaw, a hole, or the like. Therefore, with the piston 130 is completely moved back to be in a state ready to fire, the locking portion 131 is hooked by a locking protrusion 251 of the locking member 250 to maintain the state ready to fire. In addition, when the locking is released by the locking member 250, the piston 130 enters the cylinder 121 by an elastic force of a main spring 140 installed at rear of the piston 130, and thereby compressed air at high pressure is provided to the nozzle 121*c* to fire the projectile 10. Here, the main spring 140 is installed at the rear of the piston 130 inside the barrel portion 111, is compressed by the piston 130 moving backward, launches the piston 130 into the cylinder body 121*a* by the elastic force when a lock by the locking member 250 is released, and thereby the projectile 10 may be fired using the air at high pressure.

The cylinder assembly 120 with the configuration described above moves forward by spring restoring force of the return spring 125 when the rack gear tooth 123*c* is separated from a cam gear 230 with the cylinder assembly 120 is moved back along with the piston 130. In addition, the projectile 10 supplied to the cartridge chamber 115 may be positioned in front of the cylinder head 122 when the cylinder assembly 120 is moved backward.

As illustrated in FIGS. 1 and 12, the driving control mechanism 200 includes a driving unit 201, the power supply unit 210, the driving motor 220, the sensing unit 280, a control unit 286, and a stopper 300.

The driving unit 201 includes the cam gear 230, a gear train 240, the locking member 250, a release lever 260, a trigger 270, etc. The cam gear 230 includes a gear tooth 231*a* formed at a portion of an outer circumference of the cam gear 230 to selectively engage with the rack gear tooth 123*c* of the rack gear portion 123 to move the cylinder 121 backward using power generated by the driving motor 220.

In addition, as illustrated in FIG. 6, the cam gear 230 includes a cam gear body 231, a cam portion 232 eccentrically installed at the rotating center of the cam gear body 231, and a driven gear 233 which receives power from the gear train 240. The cam gear 230 with the configuration described above rotates by receiving the power of the driving motor 220 via the gear train 240. In the state of FIG. 6, the gear tooth 231*a* is connected and interlocked with the rack gear tooth 123*c* when the cam gear 230 makes one rotation, and thereby the cylinder assembly 120 moves backward along with the piston 130. Here, it is preferable that the number of the gear tooth 231*a* be the same as the number of the rack gear tooth 123*c* so that the backward movement of the cylinder 121 is completed by the one rotation of the cam gear 230.

When the cylinder assembly 120 and the piston 130 are completely moved back, the piston 130 is hooked by the locking member 250 to maintain being moved back (a state ready to fire), and the cylinder assembly 120 moves forward by an elastic restoring force of the return spring 125 when the gear tooth 231*a* of the cam gear 230 and the rack gear tooth 123*c* become separated.

The gear train 240 is for decelerating power of a driving gear 221 installed at the shaft of the driving motor 220 and transferring the power to the driven gear 233 of the cam gear 230, and since diverse examples are available and the present invention is not limited by technical configurations of the gear train, detailed descriptions thereof will be omitted.

One end of the locking member 250 is rotatably installed in the toy gun main body 110 and the other end is connected to the release lever 260 to be interlocked. The locking member 250 described above includes the locking protrusion 251 coupled and locked to the locking portion 131 of the piston 130 moved back, as illustrated in FIG. 9.

As an example, the release lever 260 is rotatably installed in the toy gun main body 110 and includes an interlocking bar 261 which extends in one direction from the center of rotation and is connected to the other end of the locking member 250 and an interference bar 262 which extends in a direction opposite the interlocking bar 261 from the center of rotation. The interference bar 262 is a portion interfered by the cam portion 232 when the cam gear 230 rotates, and when the cam portion 232 moves from the state of FIG. 10 to the state of FIG. 11, the interference bar 262 rotates by the cam portion 232 to be the state of FIG. 11. Then, the release lever 260 rotates, the locking member 250 connected to the release lever 260 also rotates in conjunction therewith, the locking protrusion 251 is separated from the piston 130, and thereby the piston 130 may be launched. Although not shown in the drawings, the interference bar 262 may be formed in a shape extending toward an upper portion of the sensing unit 280, the interference bar 262 moves toward the upper portion of the sensing unit 280 when cocking the toy gun, and the movement of the interference bar 262 may be detectable by the sensing unit 280. Here, the term "cocking" refers to a movement of the piston 130 into the cylinder 121 to fire the projectile 10.

The trigger 270 is installed so that a portion thereof is exposed outward from the toy gun main body 110 and is rotatably installed. By pulling the trigger 270, the sensing unit 280 senses the signal and the projectile 10 is fired.

The power supply unit 210 includes a battery installed inside the toy gun main body 110, and either a rechargeable battery or a normal battery may be used for the battery.

The driving motor 220 may be installed inside the handgrip 113 of the toy gun main body 110 and operates by receiving power from the power supply unit 210.

The sensing unit 280 includes the first sensor 281 for sensing a position of the cylinder 121, a second sensor 282 for sensing motion of pulling the trigger, and a third sensor 283 for sensing the number of times firing occurred.

The first sensor 281 is positioned on a moving path of the rack gear portion 123 and senses the position of the cylinder 121 by being in contact with the rack gear portion 123. When the first sensor 281 comes in contact with the contact surface 123*a* positioned behind the groove 123*b*, the control unit 286 determines that the cylinder 121 starts to move backward and the cartridge chamber 115 is open. After this, since the first sensor 281 is inserted into the groove 123*b* during the backward movement of the cylinder 121, the first sensor 281 is not in contact with the rack gear portion 123 and thereby the control unit 286 determines that the cylinder 121 is in a process of moving backward. In addition, when the first sensor 281 is not in contact with the rack gear portion 123 after the first sensor 281 comes in contact with the contact surface 123*a* positioned in front of the groove 123*b*, the control unit 286 determines that the cylinder 121 completed the backward movement. That is, the control unit 286 may determine the position of the cylinder 121 and whether or not the backward movement of the cylinder 121 is completed depending on whether or not the first sensor 281 is in contact with the rack gear portion 123. In the same manner, the control unit 286 may determine the position of the cylinder 121 and whether or not a forward movement of the cylinder 121 is completed by using the first sensor 281 when the cylinder 121 moves forward.

In addition, the control unit 286 controls power supplied to the driving unit 201 depending on the position and the completion state of the backward and forward movement of the cylinder 121, that is, depending on whether or not the cylinder 121 has returned back to the initial position. For example, when the cylinder 121 stops during the movement before completing the backward and forward movement, the control unit 286 controls the power supply unit 210 to cut the power supplied to the driving unit 201. When the cam gear 230 rotates again in a state in which the cylinder 121 has not returned back to the initial position, the cylinder 121 collides with rear end of the toy gun main body 110, the cam gear 230 and the rack gear portion 123 continue to engage and run even though the cylinder 121 cannot move backward any more, and thereby the cylinder 121, the cam gear 230, the rack gear portion 123, and the like may be damaged. For the reason described above, the control unit 286 controls the power supply unit 210 to cut the power supplied to the driving unit 201.

The second sensor 282 is for sensing motion of pulling the trigger 270 by being in contact with the trigger 270. It is preferable that the second sensor 282 be installed on a control board inside the toy gun main body 110 and be a switching sensor which generates on/off switching signal.

The third sensor 283 may sense a release motion of the locking members 250 and occurrence of the cocking by being in contact with the interference bar 262, and the control unit 286 may count the number of the cocking occurred using the third sensor 283 and store the number of the cocking occurred in a memory (not shown). The third sensor 283 is used for sensing the number of times cocking actually occurred (the number of forward movements of the cylinder).

In addition, although not illustrated in the drawings, a fourth sensor for sensing loading and unloading of the magazine 20 may be further included.

The control unit 286 not only controls an operation of the driving motor 220 according to each sensed signal from first to third sensors 281, 282, 283 and the fourth sensor but also controls the power supply unit 210 to selectively cut or allow a power supply to the driving motor 220.

The stopper 300 is formed on a movement path of the cylinder 121 in the barrel portion 111 to block the forward movement of the cylinder 121 by controlling by the first protrusion 35. For example, when there is no projectile in the hole 32, the stopper 300 moves upward due to pressure of the first protrusion 35 to block the movement of the cylinder 121 toward the projectile fixing portion 33, and when there is a remaining projectile 10 in the hole 32, the stopper 300 moves downward to allow the movement of the cylinder 121 toward the projectile fixing portion 33 because the pressure of the first protrusion 35 is released.

Hereinafter, an operation of the toy gun with the configuration described above according to the first embodiment of the present invention will be described in detail.

To prepare for firing, the control unit 286 controls the power supply unit 210, the driving motor 220, the driving unit 201, etc. to reciprocate the cylinder 121 (moving backward to moving forward) in the toy gun main body 110. First, the rack gear portion 123 and the cam gear 230 engage to move the cylinder 121 backward while the cam gear 230 makes one rotation. Here, the piston 130 moves backward along with the cylinder 121.

After this, when the cylinder assembly 120 and the piston 130 completely move back as illustrated in FIG. 9, the piston 130 is fixed by the locking member 250 in the state of being moved back, and the cylinder 121 moves forward by the return spring 125 as the rack gear portion 123 and the cam gear 230 are separated, as illustrated in FIG. 10. Here, when there is no projectile in the hole 32, the plate 34*a* and the first protrusion 35 are spaced apart from each other as the plate 34*a* moves toward the hole 32, and thereby the first protrusion 35 rotates upward. Accordingly, the first protrusion 35 blocks the cylinder 121 from moving toward the projectile fixing portion 33. Conversely, when there is a remaining projectile 10 in the hole 32, the first protrusion 35 allows the cylinder 121 to pass the connector 30 and move toward the projectile fixing portion 33 because the plate 34*a* lays down and fixes the first protrusion 35.

The control unit 286 determines the position of the cylinder 121 and whether or not the backward and forward movement of the cylinder 121 is completed using the first sensor 281 while the cylinder 121 moves backward and forward. When the backward and forward movement of the cylinder 121 is not completed, the control unit 286 cuts power supplied to the driving unit 201 to prevent the cam gear 230 from rotating again.

In addition, even when a user pulls the trigger 270 before the cylinder 121 is not completely returned back to the initial position, the control unit 286 controls the locking member 250 to prevent the piston 130 from moving forward.

Conversely, when the cylinder 121 returns normally back to the initial position, the control unit 286 supplies power again to maintain a state ready to fire, and when a user pulls the trigger 270 in this state, the control unit 286 drives the driving motor 220 based on a switching signal of the second sensor 282. Next, the cam gear 230 further rotates to make the cam portion 232 rotate the release lever 260, and the piston 130 hooked by the locking member 250 interlocked with the interference bar 262 rotating as illustrated in FIG. 11 is strongly launched by elastic force of the main spring 140. In addition, the projectile 10 loaded into the cartridge chamber at front end of the cylinder assembly 120 is fired by the high pressure of air generated when the piston 130 rapidly returns back to the inside of the cylinder body 121*a*.

As described above, the cam gear 230 is controlled to make one rotation, and an operation of firing one shot of the projectile 10 is performed by the one rotation of the cam gear 230.

According to the toy gun of the embodiment of the present invention described above, since the cylinder assembly 120 is formed to perform the operation of moving backward and returning back along with the piston 130, the projectile 10 is supplied to the space of the cartridge chamber 115 generated by the backward movement of the cylinder assembly 120, and the projectile 10 is loaded as the cylinder assembly 120 returns back. However, since the connector 30 blocks the movement of the cylinder 121 when there is no projectile, unnecessary movement of the cylinder 121 may be prevented, and a user may be informed that there is no projectile.

In addition, a recoil force as is generated when a real gun is fired may be implemented through the operation of the cylinder assembly 120 that repeatedly moves backward and forward, that is, through the recoil generated when the cylinder assembly 120 returns back, and thereby providing a user with a sense of reality when firing.

Second Embodiment

As illustrated in FIGS. 13 and 14, a toy gun according to the second embodiment of the present invention has the same configuration and operation as the toy gun of the first embodiment except a connector 40 and a stopper 400.

As illustrated in FIG. 15, the connector 40 of the second embodiment includes a connector body 41, a hole 42, a projectile fixing portion 43, a projectile sensing portion 44, a first protrusion 45, a second protrusion 46, and a cylindrical entrance 47. The connector 40 may be fixed inside a toy gun main body 110 or may be inserted into the toy gun main body 110 along with a magazine 20 when the magazine 20 is inserted into the toy gun main body 110.

The connector body 41, the hole 42, the projectile fixing portion 43, the projectile sensing portion 44, the second protrusion 46 and the cylindrical entrance 47 are the same as those in the first embodiment, but the first protrusion 45 is different from that in the first embodiment.

The first protrusion 45 is inserted into rear end of the connector body 41 to be vertically rotatable about a first rotating shaft 45*d*. The first protrusion 45 is allowed to rotate by the projectile sensing portion 44 depending on whether or not a projectile remains in the hole 42. In other words, the first protrusion 45 is fixed or allowed to rotate depending on a position of the projectile sensing portion 44. In addition, when the first protrusion 45 is allowed to rotate by the projectile sensing portion 44, the first protrusion 45 rotates by pressure of the stopper 400 which controls movement of a cylinder 121 in a toy gun 100.

The first protrusion 45 includes a front end portion 45*a* in contact with rear end of the projectile sensing portion 44, a rear end portion 45*b* pressed by the stopper 400, and a rotating shaft 45*c* positioned between the front end portion 45*a* and the rear end portion 45*b* depending on whether or not a projectile remains in the hole 42. A lower surface of the front end portion 45*a* is in contact with rear end of a plate 44*a*, and a lower surface of the rear end portion 45*b* is pressed by the stopper 400. In addition, the rear end portion 45*b* includes a slope in which a lower surface is formed to be longer than an upper surface, and the slope is formed so that the cylinder 121 easily passes above the connector 40.

The first protrusion 45 is interlocked with the projectile sensing portion 44 to rotate, depending on whether or not a projectile remains in the hole 42, and controls movement of the cylinder 121 by the rotation. For example, when there is a remaining projectile 10 in the hole 42 as illustrated in FIGS. 16A and 16B, rear end of the plate 44*a* fixes the front end portion 45*a* not to rotate downward. Therefore, the rear end portion 45*b* blocks the stopper 400 from moving upward. Accordingly, the stopper 400 allows the cylinder 121 to pass the connector 40 and move toward the projectile fixing portion 43.

Conversely, when there is no projectile in the hole 42 as illustrated in FIGS. 17A and 17B, the plate 44*a* and the front end portion 45*a* are spaced apart from each other, as the plate 44*a* moves toward the hole 42, and thereby the front end portion 45*a* is allowed to rotate downward about the rotating shaft 45*c*. Therefore, the rear end portion 45*b* allows the stopper 400 to move upward. Accordingly, the stopper 400 blocks the cylinder 121 from moving toward the projectile fixing portion 43. Here, although the rear end portion 45*b* itself may be formed to control the movement of the cylinder 121 by vertically rotating about the rotating shaft 45*c*, the rear end portion 45*b* controls the movement of the cylinder 121 by allowing the stopper 400 to move upward in the present embodiment.

The stopper 400 is formed on a movement path of the cylinder 121 in a barrel portion 111 to block a forward movement of the cylinder 121 according to controlling by the first protrusion 45. For example, when there is no projectile in the hole 42, rotation of the first protrusion 45 is allowed, the stopper 400 moves upward due to elasticity of a spring 410 positioned thereunder, and thereby the stopper 400 blocks the cylinder 121 from moving toward the projectile fixing portion 43. Conversely, when there is a remaining projectile 10 in the hole 42, the first protrusion 45 is fixed, and thus the stopper 400 does not move upward but is fixed. Therefore, the stopper 400 allows the cylinder 121 to move toward the projectile fixing portion 43.

Hereinafter, an operation of the toy gun with the configuration described above according to the second embodiment of the present invention will be described in detail.

To prepare for firing, the control unit 286 controls the power supply unit 210, the driving motor 220, the driving unit 201, etc. to reciprocates the cylinder 121 (moving backward to moving forward) in the toy gun main body 110. First, the rack gear portion 123 and the cam gear 230 engage to move the cylinder 121 backward while the cam gear 230 makes one rotation. Here, the piston 130 moves backward along with the cylinder 121.

After this, when the cylinder assembly 120 and the piston 130 completely move back as illustrated in FIG. 9, the piston 130 is fixed by the locking member 250 in a state of being moved back, and the cylinder 121 moves forward by the return spring 125 as the rack gear portion 123 and the cam gear 230 are separated, as illustrated in FIG. 10. However, at this point, when there is no projectile in the hole 42, the plate 44*a* and the first protrusion 45 are spaced apart from each other as the plate 44*a* moves toward the hole 42, and thereby the front end portion 45*a* is allowed to rotate downward about the rotating shaft 45*c*. Therefore, the rear end portion 45*b* allows the stopper 400 to move upward. Accordingly, the stopper 400 blocks the cylinder 121 from moving toward the projectile fixing portion 43. Conversely, when there is a remaining projectile 10 in the hole 42, the movement of the stopper 400 is blocked because the plate 44*a* fixes the first protrusion 45. Therefore, the stopper 400 allows the cylinder 121 to move toward the projectile fixing portion 43.

The control unit 286 determines the position of the cylinder 121 and whether or not the backward and forward movement of the cylinder 121 is completed using the first sensor 281 while the cylinder 121 moves backward and forward. When the backward and forward movement of the cylinder 121 is not completed, the control unit 286 cuts power supplied to the driving unit 201 to prevent the cam gear 230 from rotating again.

In addition, even when a user pulls the trigger 270 before the cylinder is not completely returned back to the initial position, the control unit 286 controls the locking member 250 to prevent the piston 130 from moving forward.

Conversely, when the cylinder 121 returns normally back to the initial position, the control unit 286 supplies power again to maintain a state ready to fire, and when a user pulls the trigger 270 in this state, the control unit 286 drives the driving motor 220 based on a switching signal of the second sensor 282. Next, the cam gear 230 further rotates to make the cam portion 232 rotate a release lever 260, and the piston 130 hooked by the locking member 250 interlocked with the interference bar 262 rotating as illustrated in FIG. 11 is strongly launched by elastic force of the main spring 140. In addition, the projectile 10 loaded into the cartridge chamber at front end of the cylinder assembly 120 is fired by high pressure of air generated when the piston 130 rapidly returns back to the inside of the cylinder body 121*a*.

The connector for a toy gun according to the present invention can sense and informs a user whether or not a projectile provided by the magazine remains.

In addition, the connector for a toy gun according to the present invention can control cocking of the toy gun depending on whether or not a projectile provided by the magazine remains.

Although exemplary embodiments to describe the principle of the present invention are illustrated and described as above, the present invention is not limited to the configurations and operations as are illustrated and described herein. Rather, it should be understood by those skilled in the art that various changes and modifications may be made therein without departing from the scope and the technical spirit of the invention.

What is claimed is:

1. A connector for a toy gun to connect a magazine with the toy gun, the connector comprising:

a connector body coupled to the toy gun to be connected with an upper portion of the magazine when the magazine is inserted into the toy gun;

a hole formed to pass through front end of the connector body and configured to accommodate a projectile provided by the magazine;

a projectile fixing portion positioned on the connector body in which the hole is formed and configured to fix the projectile provided via the hole;

a projectile sensing portion which senses whether or not a projectile remains in the hole; and a first protrusion interlocked with the projectile sensing portion to control movement of a cylinder of the toy gun depending on whether or not a projectile remains in the hole, wherein the first protrusion is inserted into rear end of the connector body, and the projectile sensing portion is positioned between the hole and the first protrusion.

2. The connector of claim 1, wherein the projectile sensing portion includes a plate inserted into the connector body and a spring which pushes the plate toward the hole.

3. The connector of claim 2, wherein the plate is inserted into the hole through a side surface of the hole when there is no projectile in the hole.

4. The connector of claim 3, wherein front end of the plate has a lower surface longer than an upper surface to form a slope.

5. The connector of claim 1, further comprising a second protrusion interlocked with the projectile sensing portion and configured to protrude from the connector body depending on whether or not a projectile remains in the hole.

6. The connector of claim 5, wherein the second protrusion protrudes from the connector body when there is no projectile in the hole and is inserted into the connector body when there is a remaining projectile in the hole.

7. The connector of claim 5, wherein the second protrusion maintains an inserted state in the connector body while a remaining projectile in the hole moves toward the projectile fixing portion.

8. The connector of claim 7, wherein the second protrusion maintains an inserted state in the connector body by pressure of a lower portion of the cylinder while a remaining projectile in the hole moves toward the projectile fixing portion.

9. The connector of claim 5, wherein the second protrusion is inserted in the connector body by pressure of the cylinder moving toward the projectile fixing portion.

10. The connector of claim 1, wherein the first protrusion controls a stopper in the toy gun to block the cylinder from moving toward the projectile fixing portion when there is no projectile in the hole, and controls the stopper to allow the cylinder to move toward the projectile fixing portion when there is a remaining projectile in the hole.

11. The connector of claim 1, wherein the first protrusion is allowed to rotate by the projectile sensing portion depending on whether or not a projectile remains in the hole.

12. A connector for a toy gun to connect a magazine with the toy gun, the connector comprising:

a connector body coupled to the toy gun to be connected with an upper portion of the magazine when the magazine is inserted into the toy gun;

a hole formed to pass through front end of the connector body and configured to accommodate a projectile provided by the magazine;

a projectile fixing portion positioned on the connector body in which the hole is formed and configured to fix the projectile provided via the hole;

a projectile sensing portion whose position changes in the connector body depending on whether or not a projectile remains in the hole; and a first protrusion allowed to rotate by the projectile sensing portion depending on whether or not a projectile remains in the hole and configured to rotate by pressure of a stopper which controls movement of a cylinder in the toy gun.

13. The connector of claim 12, wherein the first protrusion is allowed to rotate by the projectile sensing portion when there is no projectile in the hole and is allowed not to rotate by the projectile sensing portion when there is a remaining projectile in the hole.

14. The connector of claim 12, wherein the first protrusion includes:

a front end portion in contact with rear end of the projectile sensing portion depending on whether or not a projectile remains in the hole;

a rear end portion pressed by the stopper; and a rotating shaft positioned between the front end portion and the rear end portion.

15. The connector of claim 14, wherein a lower surface of the front end portion is in contact with the rear end of the projectile sensing portion.

16. The connector of claim 14, wherein a lower surface of the rear end portion is pressed by the stopper.

* * * * *